US012291316B2

(12) United States Patent
Golden

(10) Patent No.: US 12,291,316 B2
(45) Date of Patent: May 6, 2025

(54) SHALLOW WATER HYDRAULIC BOAT LIFT

(71) Applicant: William Golden, North Fort Myers, FL (US)

(72) Inventor: William Golden, North Fort Myers, FL (US)

( * ) Notice: Subject to any disclaimer, the term of this patent is extended or adjusted under 35 U.S.C. 154(b) by 159 days.

(21) Appl. No.: 18/098,902

(22) Filed: Jan. 19, 2023

(65) Prior Publication Data

US 2023/0227134 A1 Jul. 20, 2023

Related U.S. Application Data

(60) Provisional application No. 63/300,783, filed on Jan. 19, 2022.

(51) Int. Cl.
*B63C 3/02* (2006.01)
*B63C 3/06* (2006.01)
*B63C 3/12* (2006.01)

(52) U.S. Cl.
CPC . *B63C 3/06* (2013.01); *B63C 3/12* (2013.01)

(58) Field of Classification Search
CPC ..... B63C 3/06; B63C 3/02; B63C 3/12
See application file for complete search history.

(56) References Cited

U.S. PATENT DOCUMENTS 481,411 A * 8/1892 Moran ..... B63C 3/06 405/3
2,505,832 A * 5/1950 Lange ..... B63C 3/06 187/211
3,025,984 A * 3/1962 Klingele ..... B63C 3/06 414/460
4,641,996 A * 2/1987 Seal ..... B63C 3/06 187/245
4,678,366 A * 7/1987 Williamson ..... B63C 3/06 405/1
5,140,923 A * 8/1992 Wood ..... B63B 23/34 D34/28
5,143,182 A * 9/1992 Basta ..... B63C 3/06 187/408
5,184,914 A * 2/1993 Basta ..... B63C 3/06 D34/28
5,275,505 A * 1/1994 Wilcox ..... F15B 15/262 114/44
5,318,380 A * 6/1994 Murray ..... B63C 3/08 405/2

(Continued)

*Primary Examiner* — Edwin J Toledo-Duran
(74) *Attorney, Agent, or Firm* — William E. Noonan

(57) ABSTRACT

A cylinder mounting assembly for a hydraulic boat lift includes a plurality of H-frame components for pivotally connecting a pair of bunks to side beams of the lift. A trailing pair of hydraulic cylinder actuators pivotally interconnect the side beams to respective trailing H-frame components. The cylinders are selectively operated to pivot the trailing H-frame components closed such that a first longitudinal channel of each trailing H-frame component receives a respective actuator and an opposite, second longitudinal channel of the trailing H-frame component receivably interengages a respective side beam, which lowers the bunks of the lift sufficiently to facilitate driving a vessel onto and launching a vessel from the lift in shallow water conditions.

13 Claims, 8 Drawing Sheets

(56) References Cited

U.S. PATENT DOCUMENTS 5,427,471 A * 6/1995 Godbersen ..... B63C 3/06 187/266
5,485,798 A * 1/1996 Samoian ..... B63C 1/02 405/3
5,655,850 A * 8/1997 Holmgren ..... B63C 1/02 405/1
5,803,003 A * 9/1998 Vickers ..... B63C 3/06 405/3
5,890,835 A * 4/1999 Basta ..... B63C 3/06 114/44
5,908,264 A * 6/1999 Hey ..... B63C 3/06 114/44
6,230,639 B1 * 5/2001 McLaughlin ..... B66F 7/02 405/3
6,327,990 B1 * 12/2001 Crifase ..... B63B 21/00 405/1
6,408,776 B1 * 6/2002 McLaughlin ..... B66F 7/02 114/44
6,435,768 B1 * 8/2002 Mansfield ..... B66D 1/56 114/44
6,470,816 B1 * 10/2002 Golden ..... B63C 3/06 405/3
6,575,661 B1 * 6/2003 Phillips ..... B63C 3/06 414/678
6,976,442 B2 * 12/2005 Hey ..... B66F 7/0641 405/3
8,291,810 B2 * 10/2012 Hey ..... F16J 3/046 92/87
8,696,240 B2 * 4/2014 Baas ..... B63C 3/02 405/1
8,911,174 B2 * 12/2014 Hey ..... B63C 3/06 114/361
8,979,426 B2 * 3/2015 Doig ..... B63C 3/06 114/44
11,518,484 B1 * 12/2022 Uhde ..... B66F 9/07509
11,932,364 B2 * 3/2024 Hey ..... B63C 3/12
2001/0006590 A1 * 7/2001 Bishop ..... E02C 5/00 405/86
2002/0083876 A1 * 7/2002 Gibson ..... B63C 3/06 114/45
2002/0178986 A1 * 12/2002 Crifase ..... B63C 3/06 114/219
2004/0184883 A1 * 9/2004 Basta ..... B66F 7/08 114/44
2005/0084332 A1 * 4/2005 Edson ..... B63C 3/06 405/3
2005/0235893 A1 * 10/2005 Hey ..... B63C 3/06 114/44
2006/0147268 A1 * 7/2006 Hey ..... B63C 3/06 405/3
2008/0292402 A1 * 11/2008 Attwater ..... B63C 3/06 405/3
2009/0202300 A1 * 8/2009 Basta ..... B63C 3/06 405/3
2011/0095147 A1 * 4/2011 Mensching ..... B63C 3/06 248/176.3
2011/0297067 A1 * 12/2011 Wirsig ..... B63B 21/00 114/230.16
2012/0076585 A1 * 3/2012 Baas ..... B63C 3/02 405/3
2013/0004238 A1 * 1/2013 Doig ..... B63C 3/06 405/3
2014/0017009 A1 * 1/2014 Hey ..... B63C 3/06 405/3
2015/0158566 A1 * 6/2015 Doig ..... B29C 48/12 405/7
2016/0059942 A1 * 3/2016 D'Orazio ..... B63C 3/06 248/295.11
2020/0108899 A1 * 4/2020 De Jongh ..... B63B 23/34
2020/0385094 A1 * 12/2020 Brown ..... B63C 3/06
2021/0354794 A1 * 11/2021 Hey ..... B63C 3/06
2022/0048603 A1 * 2/2022 Buksowicz ..... B63C 3/06
2022/0355909 A1 * 11/2022 Genovese ..... B66F 7/28
2024/0278884 A1 * 8/2024 Golden ..... B63C 3/06
2024/0294239 A1 * 9/2024 Hey ..... B63C 3/06

* cited by examiner

SHALLOW WATER HYDRAULIC BOAT LIFT

FIELD OF THE INVENTION

This invention relates to a shallow water hydraulic boat lift. More particularly, the invention relates to a system for arranging and mounting the hydraulic cylinders of the boat lift so that the lift can be lowered sufficiently to facilitate driving a boat onto or launching the boat from the lift when the water level is exceptionally low.

BACKGROUND OF THE INVENTION

In order to effectively maneuver a boat onto or launch the boat from a boat lift, the underlying water depth must be sufficient to power the vessel effectively onto or off of the bunks, platform, cradle beams, or other supportive structure of the lift. If the water level is too low or, more particularly, below the lowermost operable height of the lift, it is difficult, if not impossible, to successfully maneuver the vessel onto or off of the lift.

Conventional hydraulic boat lifts employ hydraulic cylinders to pivotably raise and lower the supportive structure of the lift. These cylinders are currently arranged and mounted so that, in the fully collapsed or lowered condition, the vessel-supporting bunks of the lift are spaced two feet or more above the base of the lift and hence the bottom of the body of water in which the lift is installed. During conditions of severe drought, the water may fall to shallow depths below that level. This can cause the serious problem described above. The depth may be insufficient to allow a boat to be driven onto or launched from the lift.

Conventional hydraulic boat lifts often employ cross beams fixedly interconnected between a pair of laterally aligned, bunk-supporting posts of the lift. These cross beams support the hydraulic cylinders. Such structure does not allow the bunks of the lift to be conveniently adjusted to accommodate different sizes of vessels.

SUMMARY OF THE INVENTION

It is a therefore an object of this invention to provide an improved cylinder mounting assembly that allows a hydraulic boat lift to be lowered to a much greater degree so that a supported vessel is better able to be successfully maneuvered onto or launched from the lift when the surrounding water level is exceedingly shallow.

It is a further object of this invention to provide a shallow water hydraulic boat lift that operates more effectively than conventional lifts, especially during periods of severe drought and other instances when the water level is unusually low.

It is a further object of this invention to provide a cylinder mounting system for a hydraulic boat lift that enables the lift to be collapsed into an extremely compact condition not achievable by conventional lifts.

It is a further object of this invention to provide a hydraulic boat lift that eliminates the prior use of cylinder-mounting cross beams to fixedly interconnect the bunks of the lift and which thereby allows the bunks to be readily adjusted to accommodate various sizes of vessels.

This invention features a hydraulic boat lift and, more particularly, a cylinder mounting assembly used in such a hydraulic lift. The lift includes a supportive base that features a framework including a pair of generally parallel first and second side beams. A first laterally adjacent pair of leading support posts are pivotably attached at their lower ends to the first and second side beams respectively proximate a leading (bow) end of the framework. A second spaced apart pair of laterally adjacent trailing support posts are likewise pivotally attached at their lower ends to the respective side beams proximate an opposite, trailing (stern) end of the framework. The support posts attached to the first side beam, in turn, carry a first elongate bunk that is pivotally connected to both such support posts. Likewise, the support posts attached to the second side beam carry and are pivotally connected to a second elongate bunk. Each post of the trailing pair of support posts includes a trailing elongate H-frame component. Each trailing H-frame component includes a first, bow-facing channel formed longitudinally in the trailing H-frame component and an opposite second, stern-facing channel. The trailing H-frame component of each trailing support post is pivotally connected within its first channel to one end of a respective hydraulic actuator cylinder. The opposite end of that hydraulic actuator cylinder is pivotally interconnected to a top surface of a respective one of the first and second side beams. The hydraulic actuator cylinders are operated to selectively alternate the support posts between a raised condition, wherein the elongate bunk assemblies elevate a vessel supported thereon, and a lowered condition, wherein the trailing H-frame components are pivoted closed against the respective side beams such that the second channel of each trailing H-frame component receives and preferably conformably interengages a respective side beam. In the lowered condition, each actuator cylinder is likewise received by and oriented to extend generally longitudinally through the first longitudinal channel of a respective trailing H-frame component. The cylinder is interposed between that H-frame component and the corresponding bunk to which the H-frame component is connected. Accordingly, in the lowered condition, the distance between the bottom of each side beam and the top of the bunk connected to that side beam is reduced. The stern and operationally effective height of the lift are thereby advantageously lowered by a significantly greater degree than previously possible.

In a preferred embodiment, the leading support posts may include a pair of leading H-frame components that have opposing first and second channels, as set forth above, and that are pivotally connected proximate their lower ends to the first and second side beams respectively. Each trailing and leading H-frame component may include spaced apart flanges that define the longitudinal first and second channels formed therein. The flanges forming the second channel of each H-frame component may be pivotaly attached to respective opposite sides of a corresponding side beam such that in the lowered or collapsed condition, the H-frame component receives and compactly interengages the respective side beam to which it is attached. Each trailing H-frame component may be pivotally connected to a reciprocating arm or rod of a respective hydraulic cylinder actuator. The cylinder may be supported on a respective side beam by a pivot bracket such that each actuator mechanism is mounted to the top of a respective side beam forwardly of the attached trailing H-frame component and intermediate the trailing and leading H-frame components supported on that respective side beam.

The leading and trailing ends of the side beams may be adjustably mounted respectively on leading and trailing crossbars of the boatlift's framework or base. By arranging and mounting each actuator cylinder mechanism between a respective side beam and the bow-facing first channel of a corresponding trailing H-frame component, the system eliminates the crossbars conventionally used to support the hydraulic actuating cylinders. This allows the lift framework and bunks to be quickly and conveniently adjusted laterally in order to accommodate various sizes of boats.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
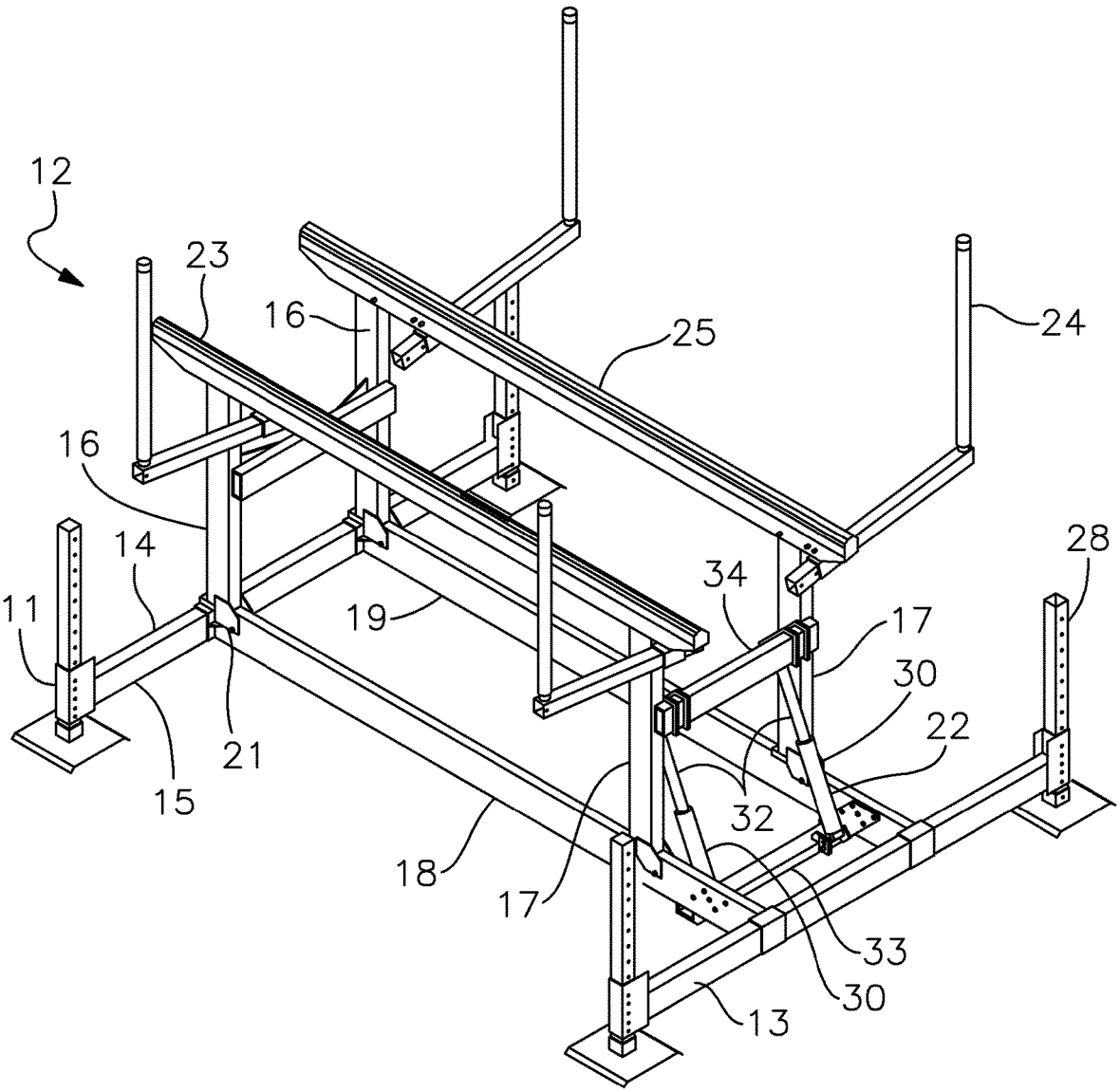
Fig. 1 (Prior Art)
FIG. 1 is a perspective view of a prior art hydraulic boat lift employing conventionally assembled hydraulic actuating cylinders for selectively raising and lowering the rift.

There is shown in FIG. 1 a known hydraulic boat lift mechanism 12. The lift comprises a base 11 including framework 14 is adjustably mounted on or below supportive stanchions 28, which are themselves mounted on the bottom or floor of a body of water. The framework may be adjusted vertically along stanchions 28 so that the height of boat lift 12 within the body of water may be set as required for a particular vessel.

Framework 14 includes a pair of first and second generally parallel side beams 18 and 19. These beams extend longitudinally between transverse beams 13 and 15, which are themselves mounted to and height adjustable along stanchions 28. A first pair of support posts 16 are pivotally mounted at their lower ends to respective longitudinal beams 18, 19 proximate a leading (bow) end of framework 14. A second pair of support posts 17 are likewise pivotally connected at their lower ends to respective longitudinal beams 18, 19 proximate the opposite trailing (stern) end of framework 14. A pair of generally parallel bunks 23, 25 are pivotally connected to the upper ends of the support posts such that each bunk 23, 25 extends between a respective pair of posts 16 and 17. The lower end of each post 16, 17 is pivotally secured to a respective lower longitudinal beam assembly 18, 19 by a respective pivot bracket 21.

Figure 7:
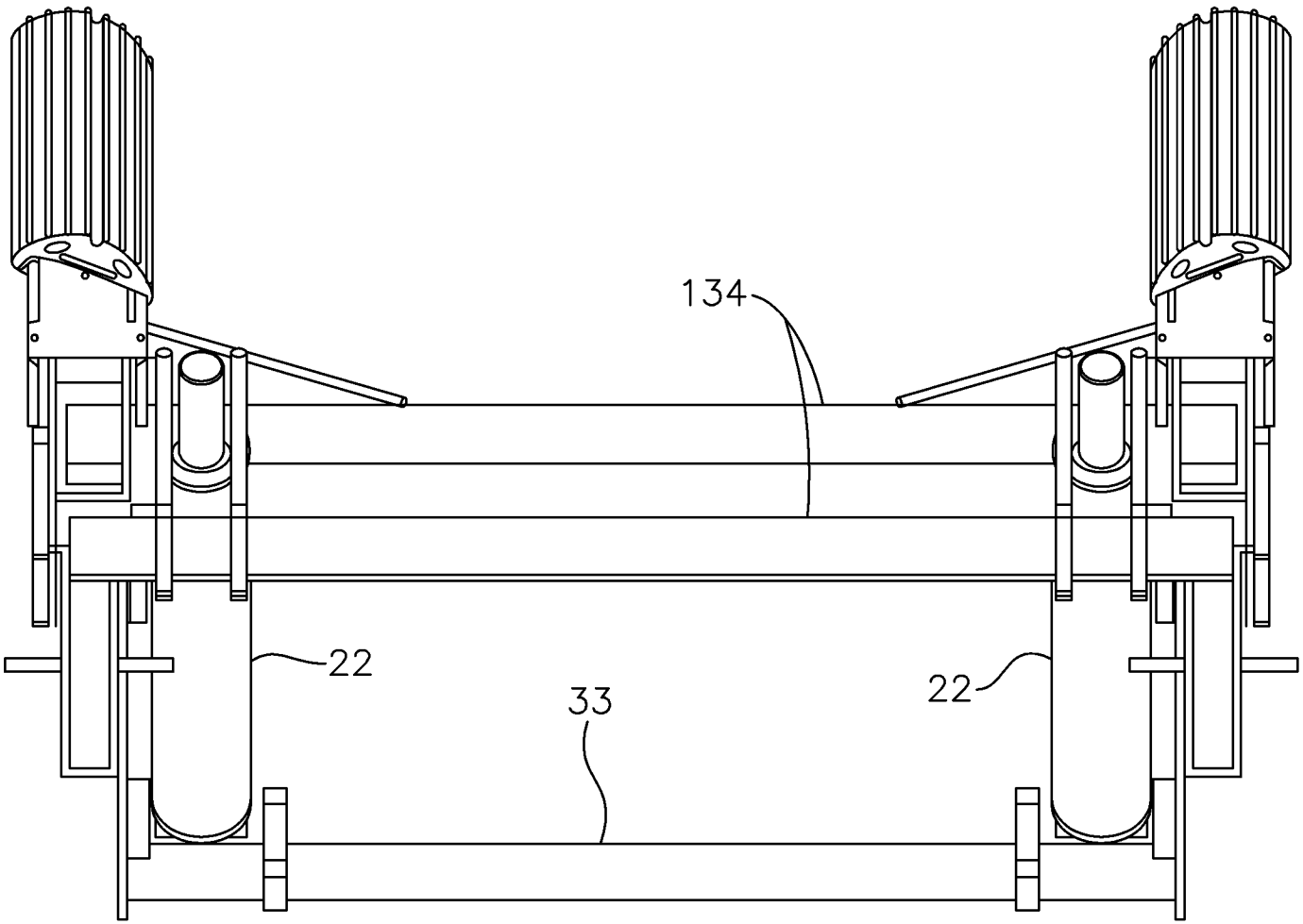
Fig. 7 (Prior Art)
FIG. 7 is a fragmentary perspective end view of a prior art hydraulic lift in a collapsed condition and particularly showing the distance between the bunk and the bottom of the side frame, which indicates the maximum degree (24¼") to which the lift can be lowered using the typical prior art actuating cylinder construction.

The pivoting support posts 16, 17 and bunks 23, 25 mounted on the support posts are selectively raised and lowered in a known manner by a pair of hydraulic cylindrical actuators 22. Each cylinder 22 includes a conventional construction. In particular, each actuator 22 includes an elongate hydraulic cylinder housing 30 supported pivotally at its lower end by a transverse cylinder mount 33 extending between side beams 18 and 19. As will be understood to persons skilled in the art, a cylinder rod 32 is operatively engaged with cylinder housing 30. Cylinder rod 32 is attached to an internal piston (hidden from view) that is mounted for sliding in a reciprocating manner within cylinder housing 30. Each cylinder rod extends upwardly from its respective cylinder housing 30 and is connected to an upper cross beam 34 extending between posts 17. The construction and operation of these actuators are described in my U.S. Pat. Nos. 10,518,852 and 10,520,083, which are incorporated herein by reference. A slightly different prior art system for mounting the actuating cylinders is depicted in FIG. 7 described below.

Bunks 23, 25 are constructed and utilized in a known manner to support a boat or other watercraft vessel on boat lift 12. It should be understood that boat lift 12 may also include a number of other conventional boat lift components. For example, as further shown in FIGS. 1 and 2, vertical guides 24 may be mounted to and extend upwardly from bunk assemblies 23, 25. Guides 24 help to property position the boat B onto boat lift 12. It should also be understood that the above-described boat lift construction is largely conventional.

Actuator cylinder mechanisms 22 are operated, for example in the manner shown in U.S. Pat. No. 10,520,083, to selectively lower and raise lift 12. In the lowered condition shown in FIG. 2, the actuator cylinders are retracted such that the rod of each cylinder mechanism is pulled into its respective cylinder housing, which causes posts 17 to pivotally collapse or lower as indicated by arrow 36. Bunk 23 and obscured bunk 25 are thereby lowered into the position shown. Cylinder mechanisms 22, cylinder mount 33, posts 17 and bunks 23 and 25 are collapsibly interengaged in the manner generally shown in FIG. 2. The construction and arrangement of these elements and their pivotal interconnections significantly limit the degree to which the bunk can be collapsed and lowered. At the lift's lowermost position, the right-hand, trailing (stern) ends of bunks 23 and 25 are spaced approximately 24¼" above the bottom of the lift. If, as a result of drought or other conditions causing an unusually low or shallow water depth, the water level drops below this height and therefore below the lowest possible operational height of lift 12, it may be impractical if not impossible to drive a vessel onto bunks 23 and 25 or similarly to launch a vessel from the lowered bunks of the lift.

Figure 3:
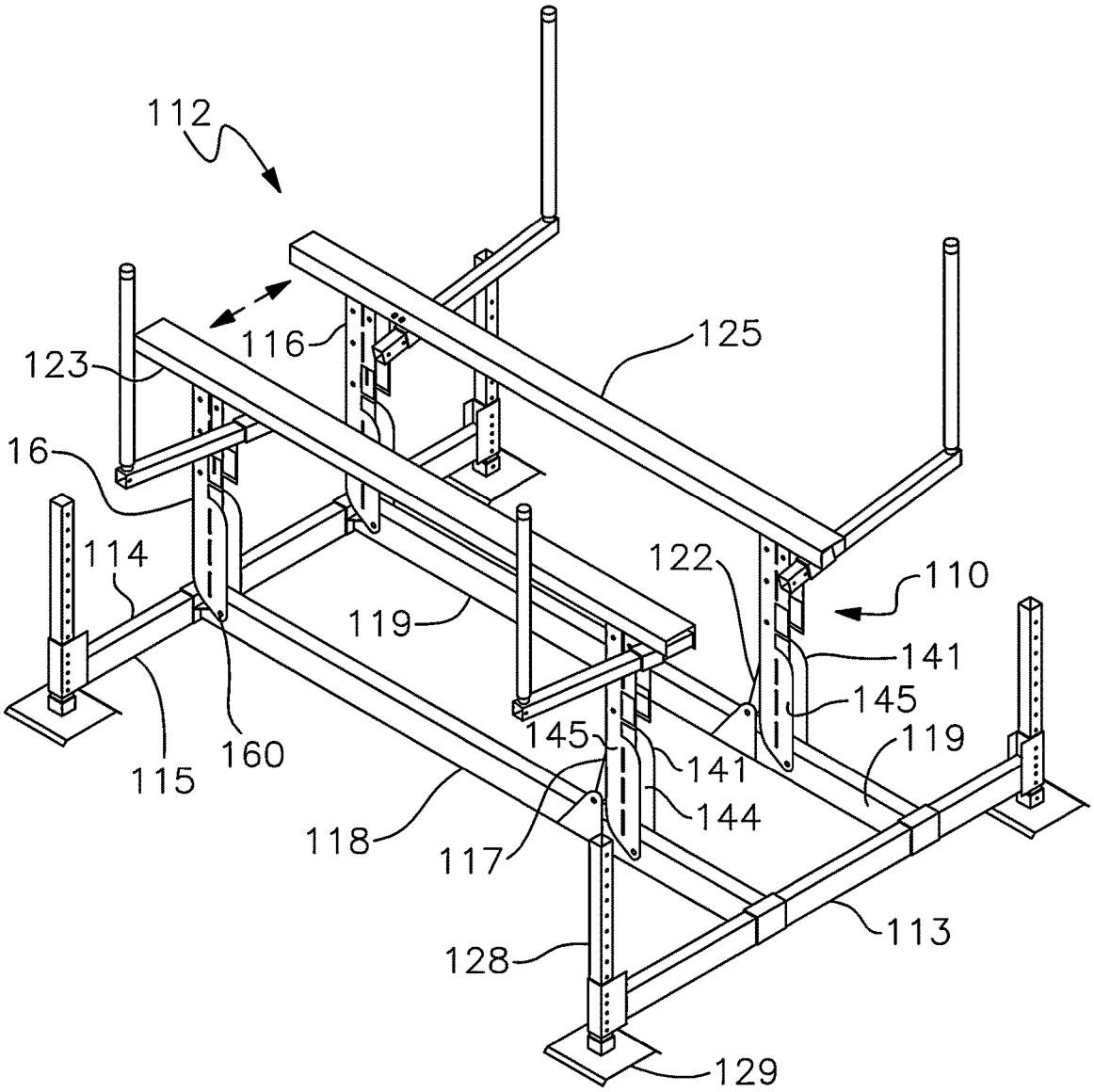
FIG. 3 is perspective view of a hydraulic boat lift utilizing the cylinder mounting assembly of this invention, which permits the boat lift to be lowered to a height significantly less than that achievable in prior art lifts.

The present invention addresses and overcomes the foregoing problem. As shown in FIG. 3, hydraulic lift 112 employs a shallow water cylinder mounting assembly 110 in accordance with this invention. Otherwise, lift 112 is constructed more or less analogously to the previously described conventional hydraulic lift. In particular, lift 112 includes a base 111 having opposite leading or bow and trailing or stern ends comprising a framework 114 adjustably mounted on stanchions 128 supported on or under the sea floor or other bottom of a body of water by pads 129 or other means. Framework 114 includes a generally parallel pair of longitudinal first and second side beams 118, 119 that extend between and are attached to transverse beams 113 and 115. The transverse beams are mounted to and height adjustable on stanchions 128. A first pair of leading support posts 116 are pivotally connected by bushings 160 to respective leading (bow) ends of side beams 118 and 119. An opposite second pair of trailing support posts 117 are likewise pivotally connected at their lower ends to respective longitudinal beams 118, 119 proximate the opposite, trailing (stern) end of framework 14.

Figure 4:
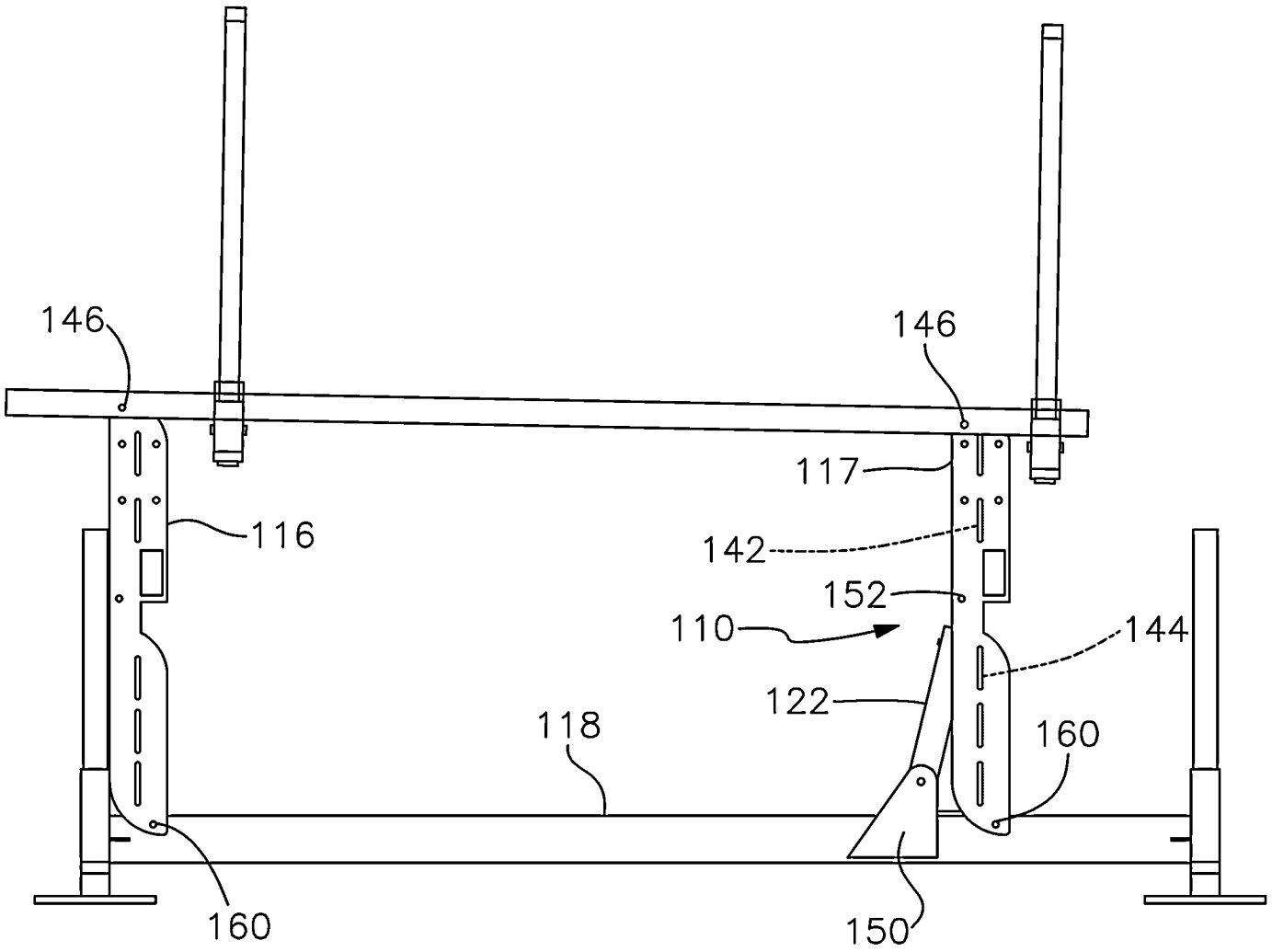
FIG. 4 is an elevational side view of hydraulic lift using the actuator cylinder mounting assembly of this invention with the lift in a raised or elevated condition.
Figure 5:
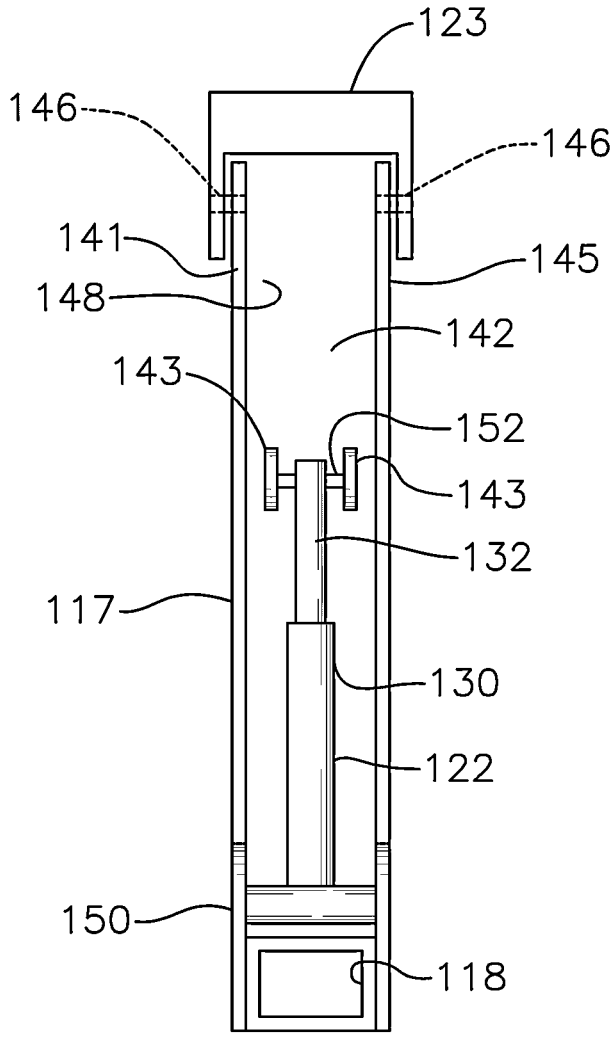
FIG. 5 is an elevational view from a leading or bow end of the lift depicting a representative hydraulic cylinder actuator mounted pivotally at one end to a respective side beam of the lift and at an opposite end to an associated trailing H-frame component within the bow-facing second channel of the H-frame component.

As further shown in FIGS. 4 and 5, support posts 116 and 117 respectively comprise elongate leading (bow) and trailing (stern) H-frame components. Each component 116, 117 features a generally H-shaped cross-sectional configuration and has a pair of spaced apart longitudinal flanges 141, 145 laterally interconnected by a longitudinal web 148 to define a longitudinal first channel 142 that faces forwardly or toward the bow of the lift when the lift is raised. Each H-frame component 116, 117 also includes an opposite longitudinal second channel 144, as best shown in FIGS. 3 and 4. Channel 144 faces rearwardly or toward the stern of the lift when the lift is raised. An elongate first vessel supporting bunk 123 extends between and is pivotally connected to the H-frame components 116, 117 attached to side beam 118. A second elongate bunk 125 is similarly supported at the upper ends of the H-frame components 116, 117 mounted to side beam 119. The bunks may feature various single and multiple piece assemblies or constructions within the scope of this invention that will be understood to persons skilled in the art. As indicated by representative bunk 123 in FIG. 5, each bunk is secured to its respective H-frame component by pivot pins or bushings 146.

Cylinder mounting assembly 110 is constructed and operated to achieve the advantageous results of this invention. In particular, each bunk 123, 125 is supported by a pair of support posts comprising respective leading and trailing H-frame components 116, 117 as previously described. The H-frame components, as well as other components of the hydraulic lift, may be composed of a marine grade, durable and corrosion resistant metal or metal alloy and other materials as will be known in the boat lift industry. A respective hydraulic cylinder actuator 122 is operatively interconnected between each stern or trailing H-frame component 117 and an associated one of side beams 118 and 119. Each actuator 122 includes a first reciprocating part comprising a cylinder 130 and a second reciprocating part comprising a hydraulic piston rod or arm 132 operatively engaged with cylinder 130. The lower end of cylinder 130 is pivotally connected to the top surface of a respective side beam 118, 119 by a pivot bracket 150 that is welded or otherwise fixed to the respective side beam. The opposite end of actuator 122, namely piston rod 132, is pivotally interconnected to trailing H-frame component 117. In particular, rod 132 is interconnected by a pin or bushing 152, FIG. 5, that extends transversely through first channel 142 and is attached to a mounting ear 143 within channel 142. As best shown in FIG. 4, each cylinder actuator 122 is thereby pivotally mounted to a respective side beam 118, 119 forwardly of the point at which the trailing H-frame component 117 is pivotally joined by bushing 160 to its corresponding side beam. In contrast to the prior art, the cylinder actuator is thereby positioned between the leading (bow) and trailing (stern) H-frame components 116, 117, respectively, and not rearwardly or aft of the point at which the trailing support post (component 117) is attached to the side beam. In addition, unlike the prior art, actuator 122 is mounted to extend upwardly from the top surface of its respective side beam 118, 119. It is not mounted to a cross beam or otherwise positioned transversely/laterally inside of the side beams. Indeed, the foregoing construction altogether eliminates the transverse cross beams or tubes employed to support hydraulic cylinders of the prior art. See beams 33 and 34 in prior art FIGS. 1 and 2. This construction yields advantages as described below.

Figure 6:
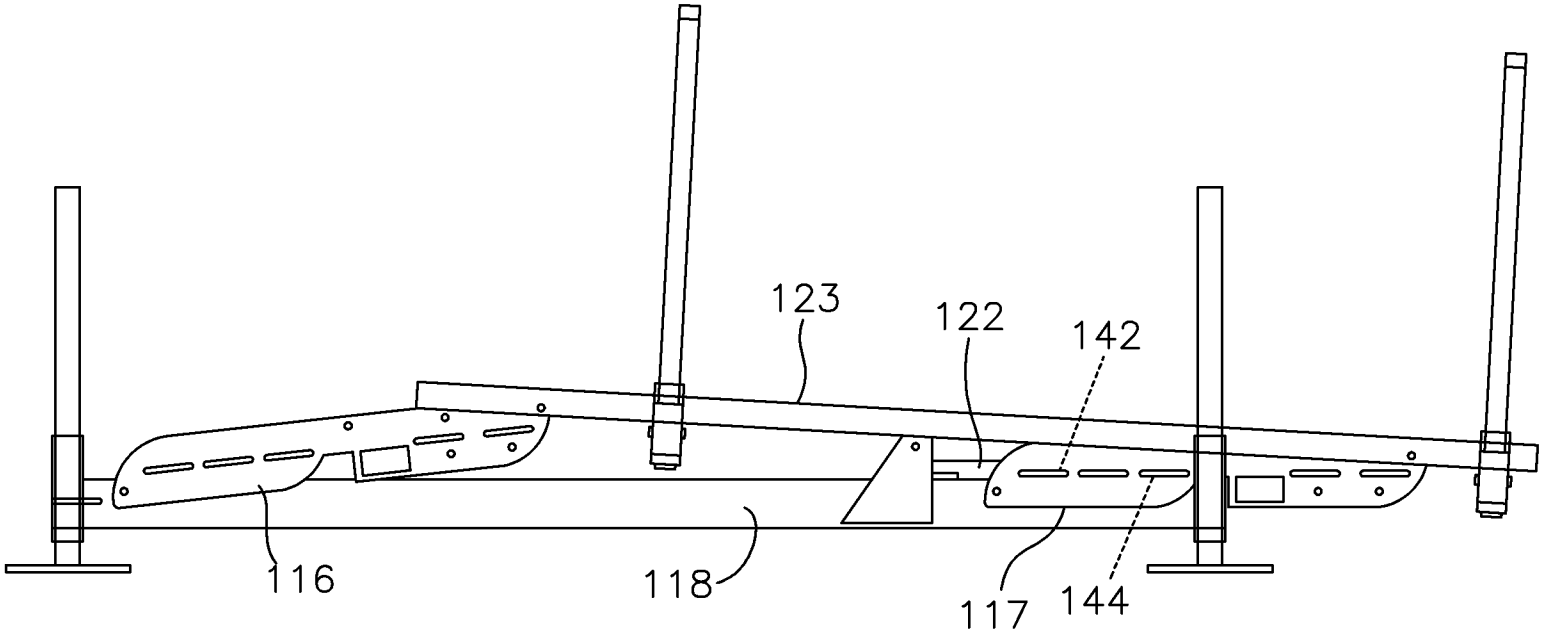
FIG. 6 is an elevational side view of a hydraulic boat lift employing the cylinder-mounting assembly of this invention and particularly illustrating how the top of the bunk is lowered to about 10½" above the bottom of the side beam.

Actuator mechanisms 122 are hydraulically operated in a manner known to those skilled in the art to selectively raise and lower supportive H-frame components 116, 177 and supported bunks 123, 125. Specifically, the hydraulic actuator retracts the rod 132 into the cylinder 130 to selectively pivot components 116, 117 upwardly and raise the lift as shown in FIGS. 3-5. Alternatively, to lower the lift, the actuator mechanisms 122 are hydraulically operated to extend rods 132 from cylinders 130. This causes the H-frame components 116, 117 to pivot downwardly, which lowers bunks 123, 125 from the position shown in FIG. 4 to that shown in FIG. 6. In particular, each component 117 pivots downwardly such that stern-facing first channels 144 of components 117 receive and generally conformably interengage respective side beams 118 and 119. Preferably channels 144 and side beams 118, 119 have generally conforming rectangular cross sectional shapes. Actuator mechanisms 122 likewise pivot downwardly until positioned substantially flat against the top surfaces of respective side beams 118, 119. The cylinders are tucked snugly into respective first channels 142 of the trailing H-frame components 117. Compact collapsing of trailing H-frame component 117 and bunks 123, 125 against side beams 118, 119 is further improved because the conventional cross beams (beams 33, 34 in FIGS. 1 and 2) are eliminated. Due to the extremely compact arrangement, configuration and construction of the hydraulic cylinder mounting assembly 110 and overall lift, the trailing end or stern of the lift is supported so that the tops of bunks 123, 125 can be lowered to a mere 10.0"-10.5", or other significantly reduced height above the bottom surfaces of side beams 118, 119.

Figure 8:
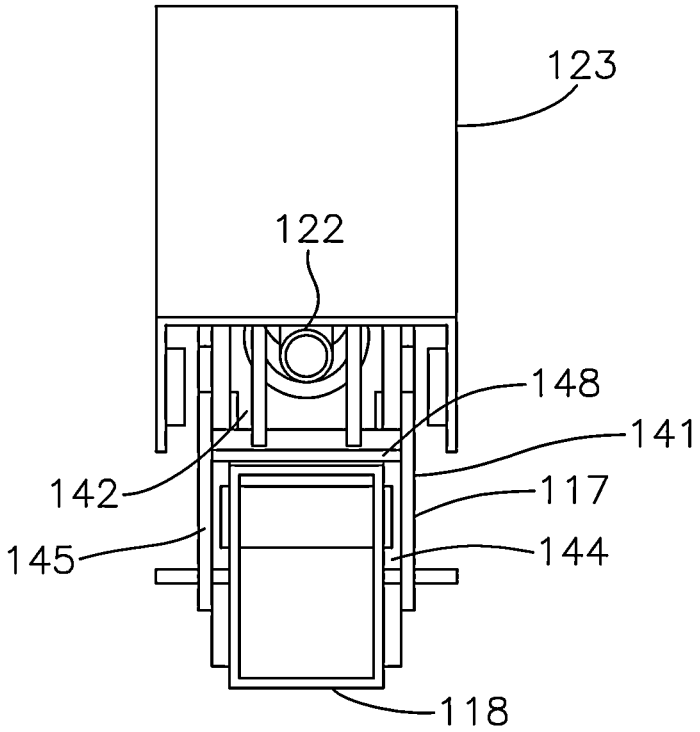
FIG. 8 is a fragmentary perspective end view of a representative cylinder mounting assembly according to this invention with the bunk beam and trailing H-frame component lowered against an assembled side beam to support the bunk 10⅛" above the bottom of the side beam

FIGS. 7 and 8 further illustrate the difference in respective heights at which the bunk is supported using the cylinder-mounting methods of the prior art and the mounting assembly of the present invention. As shown in FIG. 7, prior art cylinder mechanisms 22 are mounted between lower cylinder mount 33 and, in this different prior art construction, an upper cross tube 134. Accordingly, when the hydraulic actuator mechanisms are operated to lower the lift, cylinder actuator mechanisms 22 engage underlying boat lift structure (e.g., transverse beam 13 [FIGS. 1 and 2] of framework 14). This restricts further downward pivoting of support posts 17, which, in turn, prevents bunks 23, 25 from being lowered to a height of less than 2' or more above the bottom of the side beams 18, 19.

In contrast, as shown by the representative structure in FIG. 8, applicants trailing H-frame components 117 feature a unique longitudinal second channel 144, which receives and generally conformably and compactly engages a respective side beam 118 when the lift is closed. In particular, web 148 of component 117 flushly interengages the flat top surface of side beam 118. At the same time, opposite first longitudinal channel 142 of component 117 compactly receives and retains a respective actuator 122, which extends longitudinally through channel 142. Analogous structure is employed on the opposite side of the lift, not shown, wherein bunk 125 is supported on side beam 119. As a result, the lift is able to collapse much more compactly and lower the respective bunks to a height that is only about 10"-10" above the bottom of the side beams. This reduced height allows vessels to be successfully launched from and driven onto the bunks of the lift even when the water level is extremely low, as may be caused by drought or other seriously shallow water conditions. The added degree to which the lift employing the cylinder mounting assembly of this invention can be lowered is a significant benefit over the prior art.

Figure 2:
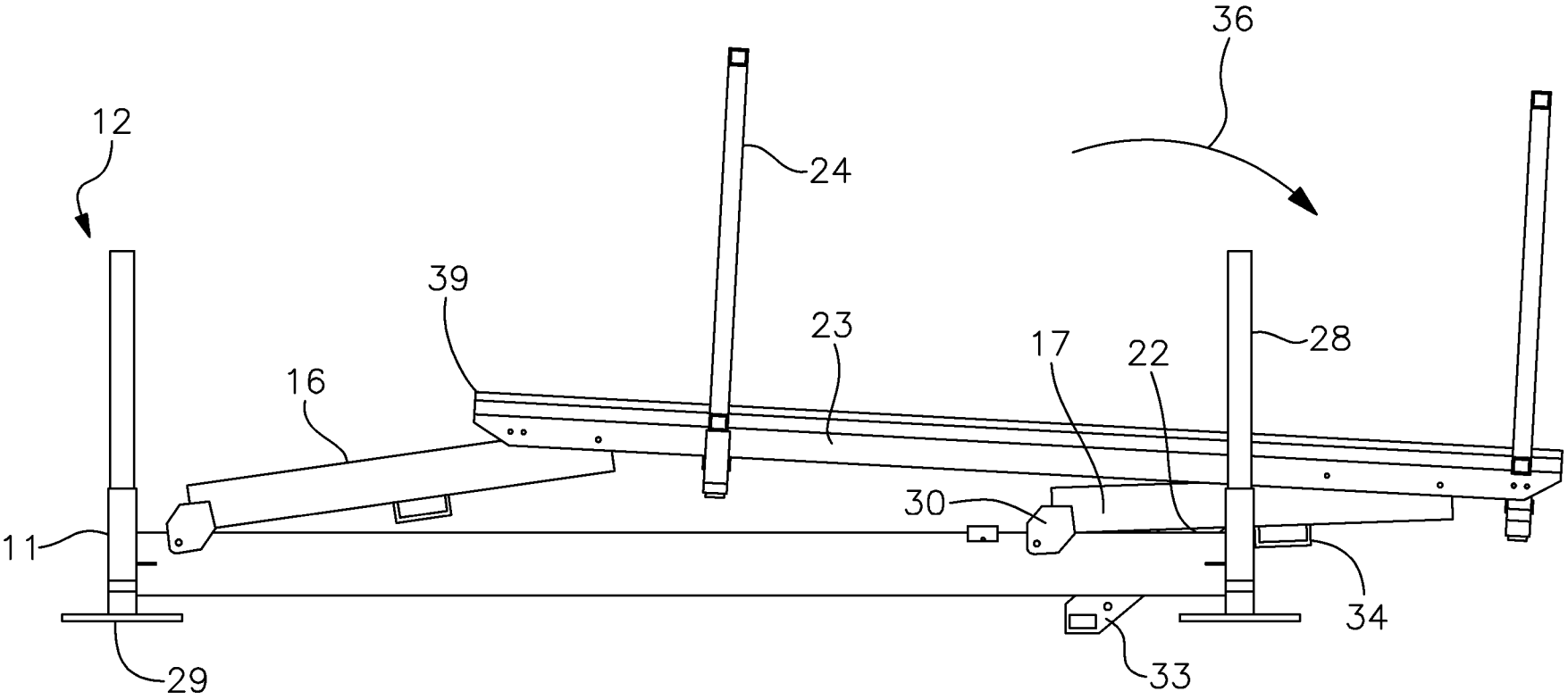
Fig. 2 (Prior Art)
FIG. 2 is an elevational side view of the lift shown in FIG. 1 and particularly illustrating the approximate maximum amount that the bunk of the lift can be lowered, i.e., to about 24¼" above the bottom of the lift.

A further advantage of the present invention is that it does not require the use of transverse beams to mount the hydraulic actuator mechanisms to the lift (see beams 33, 34, FIGS. 1, 2 and 7). These beams hold the lefthand and righthand support posts and respective bunks at a fixed width, which cannot be readily adjusted. The present invention eliminates the cross beams and allows the width of the lift and the parallel bunk assemblies to be more quickly and conveniently widened or narrowed, as needed, to accommodate various boats and vessels models and sizes.

Accordingly, the present invention relates to an improved hydraulic boat lift and in particular, to a system for arranging and mounting the hydraulic cylinders so that the lift can be lowered to reduce heights in order to facilitate launching a boat from or maneuvering a boat onto the lift when the water level is exceedingly shallow.

Although specific features of the invention are shown in some of the drawings and not others, this is for convenience only, as each feature may be combined with any and all of the other features in accordance with this invention.

What is claimed is:

1. A hydraulic boat lift comprising:

a supportive base for mounting to the bottom of a body of water, said base having opposed leading and trailing portions;

a spaced apart pair of leading support posts pivotally connected to said leading portion of said base and a spaced apart pair of trailing support posts pivotably connected to said trailing portion of said base;

a first bunk pivotally connected to and extending between a first one of said leading support posts and a corresponding first one of said trailing support posts, and a second bunk pivotally interconnected to and extending between a second one of said leading support posts and a corresponding second one of said trailing support posts, each said trailing support post including an elongate trailing H-frame component that has a pair of spaced apart longitudinal flanges laterally interconnected by a longitudinal web to define a forwardly faceable first channel and an opposite, rearwardly faceable second channel formed longitudinally in said trailing H-frame component; and a pair of hydraulic cylinder actuators, each interconnected between said base and a respective one of said trailing support posts; each said hydraulic cylinder actuator including first and second operably interconnected reciprocating parts, said first reciprocating part being pivotally connected to said base and said second reciprocating part being pivotally connected to a respective said trailing H-frame component within said first channel thereof; said hydraulic cylinder actuators being operated to pivotally alternate said leading and trailing support posts selectively between a raised condition for elevating a boat supported on said first and second bunks and a lowered condition wherein said trailing H-frame components are closed against said base and each hydraulic cylinder actuator is received by said first channel of said respective trailing H-frame component and interposed between said respective trailing H-fame component and a respective one of said first and second bunks.

2. The apparatus of claim 1 in which said base includes first and second interconnected and substantially parallel side beams, a first one of said leading support posts and a first one of said trailing support posts being pivotably connected to said first side beam, a second one of said leading support posts and a second one of said trailing support posts being pivotally connected to said second side beam.

3. The support post of claim 2 in which each said leading support post includes an elongate leading H-frame component that has a pair of spaced apart longitudinal flanges laterally interconnected by longitudinal web to define a forwardly faceable first channel and a rearwardly faceable second channel formed longitudinally in said leading H-frame component.

4. The apparatus of claim 3 in which each said pair of spaced apart longitudinal flanges are pivotally connected to respective sides of a corresponding said side beam such that in said lowered condition said second channel of each said H-frame component receives said corresponding side beam to which said H-frame component is attached.

5. The apparatus of claim 4 in which said first reciprocating part of said hydraulic cylinder actuator includes a hydraulic cylinder and said second part of said hydraulic cylinder actuator includes a piston rod operatively engaged with said hydraulic cylinder, said hydraulic cylinder being connected pivotally to a respective said side beam intermediate said leading and trailing support posts pivotally connected to said respective side beam.

6. The apparatus of claim 2 in which said base includes leading and trailing cross bars, said side beams being movably mounted to said leading and trailing cross bars to permit adjustment of the distance between said first and second side beams.

7. A hydraulic boat lift comprising:

a supportive base for mounting to the bottom of a body of water, said base having opposed leading and trailing ends; said base including first and second interconnected and substantially parallel side beams;

a spaced apart pair of leading support posts pivotally connected to said base proximate said leading end of said base and a spaced apart pair of trailing support posts pivotably connected to said base proximate said trailing end of said base, a first one of said leading support posts and a first one of said trailing support posts being pivotally connected to said first side beam, a second one of said leading support posts and a second one of said trailing support posts being pivotally connected to said second side beam;

a first bunk pivotally connected to and extending between a first one of said leading support posts and a corresponding first one of said trailing support posts, and a second bunk pivotally interconnected to and extending between a second one of said leading support posts and a corresponding second one of said trailing support posts, each said trailing support post including an elongate trailing H-frame component that has a pair of spaced apart longitudinal flanges laterally interconnected by a longitudinal web to define a forwardly faceable first channel and an opposite, rearwardly faceable second channel formed longitudinally in said trailing H-frame component; and a pair of hydraulic cylinder actuators, each interconnected between a respective one of said first and second side beams and a respective one of said trailing support posts;

each said hydraulic cylinder actuator including first and second operably interconnected reciprocating parts, said first reciprocating part being pivotally connected to one of said first and second side beams and said second reciprocating part being pivotally connected to a respective said trailing H-frame component within said first channel thereof; said hydraulic cylinder actuators being operated to pivotally alternate said leading and trailing support posts selectively between a raised condition for elevating a boat supported on said first and second bunks and a lowered condition wherein said trailing H-frame components are closed respectively against said first and second side beams and each hydraulic cylinder actuator is received by said first channel of a respective said trailing H-frame component and interposed between said respective trailing H-frame component and a respective one of said first and second bunks.

8. The support post of claim 7 in which each said leading support post includes an elongate leading H-frame component having a pair of spaced apart longitudinal flanges laterally interconnected by a longitudinal web to define a forwardly facing first channel and a rearwardly facing second channel formed longitudinally in said leading H-frame component.

9. The apparatus of claim 8 in which each said pair of spaced apart longitudinal flanges are pivotally connected to respective sides of a corresponding said side beam such that, in said lowered condition said second channel of each said H-frame component receives said side beam to which said H-frame component is attached.

10. The apparatus of claim 9 in which said first reciprocating part of said hydraulic cylinder actuator includes a hydraulic cylinder and said second part of said hydraulic cylinder actuator includes a piston rod operatively engaged with said hydraulic cylinder, said hydraulic cylinder being connected pivotally to a respective said side beam intermediate said leading and trailing support posts pivotally connected to said respective side beam.

11. The apparatus of claim 7 in which said framework includes leading and trailing cross bars, said side beams being movably mounted to said leading and trailing cross bars to permit adjustment of the distance between said first and second side beams.

12. A hydraulic boat lift comprising:

a supportive base for mounting to the bottom of a body of water, said base having opposed leading and trailing ends; said base including first and second interconnected and substantially parallel side beams;

a spaced apart pair of leading support posts pivotally connected to said base proximate said leading end of said base and a spaced apart pair of trailing support posts pivotably connected to said base proximate said trailing end of said base, a first one of said leading support posts and a first one of said trailing support posts being pivotally connected to said first side beam, a second one of said leading support posts and a second one of said trailing support posts being pivotally connected to said second side beam;

a first bunk pivotally connected to and extending between a first one of said leading support posts and a corresponding first one of said trailing support posts, and a second bunk pivotally interconnected to and extending between a second one of said leading support posts and a corresponding second one of said trailing support posts, each said trailing support post including an elongate trailing H-frame component that has a pair of spaced apart longitudinal flanges laterally interconnected by a longitudinal web to define a forwardly faceable first channel and an opposite, rearwardly faceable second channel formed longitudinally in said trailing H-frame component; each said leading post including a leading H-frame component having a pair of spaced apart longitudinal flanges laterally interconnected by a longitudinal web to define a forwardly faceable first channel and a rearwardly faceable second channel formed longitudinally in said leading H-frame component; and a pair of trailing hydraulic cylinder actuators, each interconnected between a respective one of said first and second side beams and a respective one of said trailing support posts; each said hydraulic cylinder actuator including first and second operably interconnected reciprocating parts, said first reciprocating part being pivotally connected to one of said first and second side beams and said second reciprocating part being pivotally connected to a respective said trailing H-frame component within said first channel thereof; said hydraulic cylinder actuators being operated to pivotally alternate said leading and trailing support posts selectively between a raised condition for elevating a boat supported on said first and second bunks and a lowered condition wherein said trailing H-frame components are closed respectively against said first and second side beams and each hydraulic cylinder actuator is received by said first channel of a respective said trailing H-frame component and interposed between said respective trailing H-frame component and a respective one of said first and second bunks.

13. The apparatus of claim 12 in which each said pair of spaced apart longitudinal flanges are pivotally connected to respective sides of a corresponding said side beam such that, in said lowered condition, said second channel of each said trailing and leading H-frame component receives said side beam to which said H-frame component is attached.

* * * * *